US007101036B2

(12) United States Patent
Nakashima et al.

(10) Patent No.: US 7,101,036 B2
(45) Date of Patent: Sep. 5, 2006

(54) INK-JET RECORDING APPARATUS

(75) Inventors: Atsuhisa Nakashima, Nagoya (JP); Susumu Kuzuya, Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/948,323

(22) Filed: Sep. 24, 2004

(65) Prior Publication Data

US 2005/0069369 A1 Mar. 31, 2005

(30) Foreign Application Priority Data

Sep. 26, 2003 (JP) ..... 2003-334457

(51) Int. Cl.
*B65H 5/02* (2006.01)

(52) U.S. Cl. ..... 347/104; 271/273; 346/134

(58) Field of Classification Search ..... None
See application file for complete search history.

(56) References Cited

U.S. PATENT DOCUMENTS 4,821,049 A * 4/1989 Eckl ..... 346/134
4,887,101 A * 12/1989 Hirose et al. ..... 346/134
5,274,399 A * 12/1993 Uchida et al. ..... 346/134

FOREIGN PATENT DOCUMENTS

JP 2000-062151 A 2/2000

* cited by examiner

*Primary Examiner*—Andrew H. Hirshfeld
*Assistant Examiner*—Jill E. Culler
(74) *Attorney, Agent, or Firm*—Oliff & Berridge, PLC

(57) ABSTRACT

An ink-jet recording apparatus comprises a first roller, a second roller, a looped conveyor belt, a conveyance face formed on the conveyor belt to convey a record medium, an ink-jet head, and a roller supporter. The conveyor belt is wrapped around the first and second rollers to be stretched between the first and second rollers. The ink-jet head has an ink ejection face on which nozzles each of which ejects ink are formed. The roller supporter supports the first roller so that the first roller can be swung between a conveyance position where the conveyance face is opposed to the ink ejection face in a state wherein the conveyance face is parallel to the ink ejection face, and a withdrawal position where the conveyance face is distant from the ink ejection face by a distance larger than the distance between the conveyance face and the ink ejection face when the first roller is at the conveyance position, with a swing radius shorter than the distance between the axes of the first and second rollers when the first roller is at the conveyance position.

10 Claims, 11 Drawing Sheets

INK-JET RECORDING APPARATUS

BACKGROUND OF THE INVENTION

1. Field of the Invention

The present invention relates to an ink-jet recording apparatus for recording on a record medium by ejecting ink.

2. Description of Related Art

An ink-jet recording apparatus such as an ink-jet printer has an ink-jet head on which a large number of nozzles are formed. The nozzles eject ink onto a record medium such as papers to record an image. In such apparatus, there are two types: a serial type in which recording is performed on a paper being conveyed in a sub scanning direction, with a head being moved in a main scanning direction, along the width of the paper, perpendicular to the sub scanning direction; and a line type in which recording is performed on a paper being conveyed with a fixed head having its width substantially equal to the width of the paper. Particularly in the line type, because the head need not be moved upon recording, the recording speed can be higher than that of the serial type.

In either of the serial type and the line type, in order to obtain a good image, each nozzle formed on the head must be maintained for good ink ejection. For this purpose, maintenance is carried out, which includes a purge operation for discharging ink containing therein bubbles, dust, dirt, and impurities, out of each ink flow passage in the head; and a wiping operation for wiping an ink ejection face of the head on which the nozzles are formed, so as to remove surplus ink droplets, dust, and dirt from the ink ejection face.

In the serial type, the head can be moved structurally. Thus, maintenance can be carried out after the head is moved outside the print region where the head performs a printing operation, on an extension of the line on which the head is moved upon printing. In the line type, however, because the head has its ink ejection face broader than that of the serial type, if the apparatus is designed such that maintenance is carried out after the head is horizontally moved outside the print region, it brings about an increase in size of the apparatus. In the line type, therefore, while the head is kept at the position for printing, a conveyor belt for conveying the paper is withdrawn from the position where the conveyor belt is opposed to the ink ejection face of the head, and then a maintenance unit is brought to a position where the maintenance unit is opposed to the ink ejection face of the head. Maintenance is carried out in this state.

Such a technique is known for a line-type ink-jet printer as a conveyor belt and a maintenance unit can be swung (see JP-A-2000-62151). In this technique, upon maintenance, the conveyor belt is swung by 90 degrees around one of two belt rollers to be withdrawn, and then the maintenance unit is swung by 90 degrees around a shaft opposite to the swing axis of the conveyor belt with respect to a head so that the maintenance unit is opposed to an ink ejection face of the head.

SUMMARY OF THE INVENTION

In the above-described technique, however, the whole of the conveyor belt must be swung by 90 degrees upon maintenance. Thus, a relatively large space for the swing action is required within the apparatus. This makes it difficult to reduce the size of the apparatus.

An object of the present invention is to provide an ink-jet recording apparatus wherein a reduction in size can be realized.

According to a first aspect of the present invention, there is provided an ink-jet recording apparatus comprising a first roller, a second roller, a looped conveyor belt, a conveyance face formed on the conveyor belt to convey a record medium, an ink-jet head, and a roller supporter. The conveyor belt is wrapped around the first and second rollers to be stretched between the first and second rollers. The ink-jet head has an ink ejection face on which a plurality of nozzles each of which ejects ink are formed. The roller supporter supports the first roller so that the first roller can be swung between a conveyance position where the conveyance face is opposed to the ink ejection face in a state wherein the conveyance face is parallel to the ink ejection face, and a withdrawal position where the conveyance face is distant from the ink ejection face by a distance larger than a distance between the conveyance face and the ink ejection face when the first roller is at the conveyance position, with a swing radius shorter than a distance between axes of the first and second rollers when the first roller is at the conveyance position.

According to the first aspect, because the first roller is swung with a swing radius shorter than the distance between the axes of the first and second rollers when the first roller is at the conveyance position, the space that must be ensured within the apparatus can be reduced in size. Therefore, a reduction in size of the apparatus can be realized.

According to a second aspect of the present invention, there is provided an ink-jet recording apparatus comprising a first roller, a second roller, a looped conveyor belt, a conveyance face formed on the conveyor belt to convey a record medium, an ink-jet head, and a guide groove. The conveyor belt is wrapped around the first and second rollers to be stretched between the first and second rollers. The ink-jet head has an ink ejection face on which a plurality of nozzles each of which ejects ink are formed. The guide groove guides the first roller so that the first roller can be moved between a conveyance position where the conveyance face is opposed to the ink ejection face in a state wherein the conveyance face is parallel to the ink ejection face, and a withdrawal position where the conveyance face is distant from the ink ejection face by a distance larger than a distance between the conveyance face and the ink ejection face when the first roller is at the conveyance position. A distance between axes of the first and second rollers when the first roller is at the withdrawal position is shorter than that when the first roller is at the conveyance position.

According to the second aspect, because the distance between the axes of the first and second rollers when the first roller is at the withdrawal position is shorter than that when the first roller is at the conveyance position, the space that must be ensured within the apparatus can be reduced in size. Therefore, a reduction in size of the apparatus can be realized.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Figure 1:
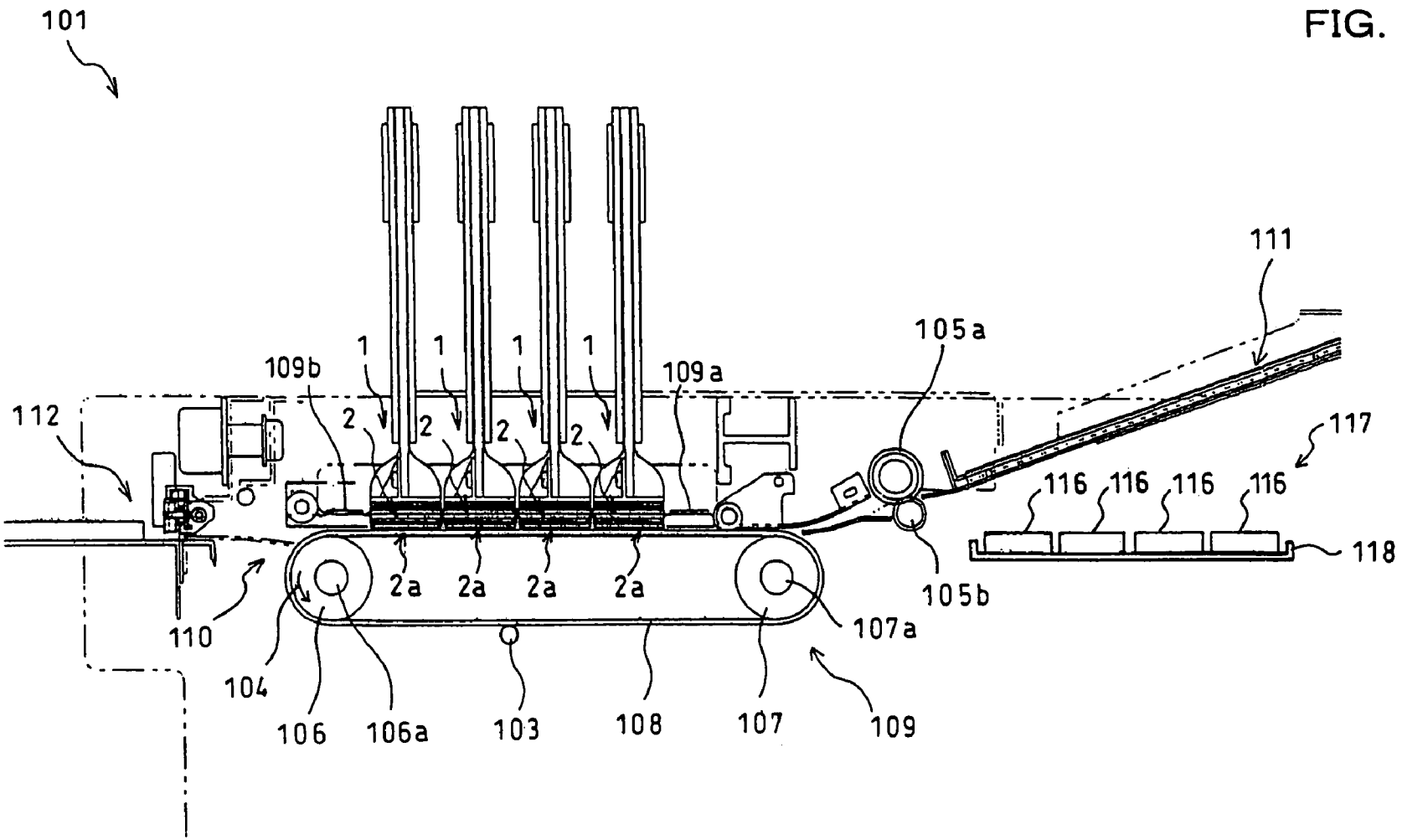
FIG. 1 is a side view showing a general construction of an ink-jet printer according to a first embodiment of the present invention.

Hereinafter, preferred embodiments of the present invention will be described with reference to the accompanying drawings.

First, a general construction of an ink-jet printer according to a first embodiment of the present invention will be described with reference to FIG. 1. The ink-jet printer 101 of this embodiment Is a color printer having four ink-jet heads 1. The ink-jet printer 101 includes therein a paper feed unit 111 on the right in FIG. 1 and a paper discharge unit 112 on the left in FIG. 1. A paper conveyance path is formed within the printer to extend from the paper feed unit 111 to the paper discharge unit 112.

A pair of paper feed rollers 105*a* and 105*b* are disposed immediately downstream of the paper feed unit 111. The paper feed rollers 105*a* and 105*b* pinch a paper as a print medium and drives the paper from the right to the left in FIG. 1. In the middle of the paper conveyance path, a belt conveyor mechanism 109 is provided under the four heads 1 so as to be opposed to the heads 1. The belt conveyor mechanism 109 includes two belt rollers 106 and 107 and a looped conveyor belt 108 wrapped around the belt rollers 106 and 107 to be stretched between the belt rollers 106 and 107. The belt rollers 106 and 107 have shaft portions 106*a* and 107*a* formed at both ends of the respective belt rollers 106 and 107. The shaft portions 106*a* and 107*a* are formed integrally with the respective belt rollers 106 and 107.

The conveyor belt 108 has a two-layer structure of a polyester base impregnated with urethane, and a silicone rubber. The silicone rubber forms an outer conveyance face of the conveyor belt 108. A paper sent from the pair of paper feed rollers 105*a* and 105*b* is pressed onto the conveyance face of the conveyor belt 108. While the paper is kept on the conveyance face of the conveyor belt 108 by adhesion, it is conveyed downstream, i.e. to the left in FIG. 1, by a counterclockwise rotation of one roller 106 as shown by an arrow 104 in FIG. 1.

A columnar belt stopper 103 is disposed below a nearly central portion of the belt conveyor mechanism 109. The belt stopper 103 is supported by a body chassis 101*a* of the printer 101 as shown in FIG. 2B. While the belt conveyor mechanism 109 conveys the paper, the belt stopper 103 is at a position near the conveyor belt 108 so as not to be in contact with the conveyor belt 108.

Pressing members 109*a* and 109*b* are provided at where the paper is put on and discharged from the conveyor belt 108, respectively. The pressing member 109*a* and 109*b* are for pressing the paper onto the conveyance face of the conveyor belt 108 so that the paper cannot separate from the conveyance face. Thus, the paper is surely conveyed by the conveyor belt 108.

A peeling plate 110 is provided immediately downstream of the conveyor belt 108, i.e. on the left of the conveyor belt 108 in FIG. 1. The peeling plate 110 peels the paper, which was kept on the conveyance face of the conveyor belt 108 by adhesion, off the conveyance face to send the paper toward the paper discharge unit 112.

Four ink-jet heads 1 are arranged in parallel along the paper conveyance path. Each ink-jet head 1 has, at its lower end, a head main body 2. Each head main body 2 is rectangular in section. The head main bodies 2 of the heads 1 are disposed close to each other such that the length of each head main body 2 is perpendicular to the direction in which the paper is conveyed, that is, the length of each head main body 2 is perpendicular to FIG. 1. Thus, the printer 101 is a line-type printer. The bottom face of each head main body 2 is opposed to the paper conveyance path and formed into an ink ejection face 2*a* on which a large number of small-diameter nozzles (not illustrated) are formed. Inks of magenta, yellow, cyan, and black are ejected from the ink ejection faces of the respective head main bodies 2.

The head main bodies 2 are disposed such that a narrow clearance is formed between the ink ejection faces 2*a* of the head main bodies 2 and the conveyance face of the conveyor belt 10B. The paper conveyance path extends within the clearance. When a paper being conveyed by the conveyor belt 108 passes immediately below the head main bodies 2 in order, the nozzles of the head main bodies 2 eject inks of the respective colors toward the upper face of the paper, i.e. the print face of the paper, to form a desired color image on the paper.

The ink-jet printer 101 is provided with a maintenance unit 117 for performing maintenance of the ink-jet heads 1. The maintenance unit 117 includes four purge caps 116 capable of covering the ink ejection faces 2*a* of the respective head main bodies 2; and a frame 118 supporting the purge caps 116. Each purge cap 116 is made of an elastic material such as rubber and can be in close contact with the corresponding ink ejection face 2*a* so as to hermetically seal the ink ejection face 2*a*.

Each purge cap 116 is connected to a waste ink tank (not illustrated) through a tube or the like. Ink discharged out of nozzles by pressure purge is received in each purge cap 116 and then collected in the waste ink tank.

The purge method is not limited to pressure purge in which ink is discharged out of each ink-jet head 1 by pressure. In a modification, suction purge may be adopted. In case of suction purge, each purge cap 116 is connected to a pump and ink is discharged out of each ink-jet head 1 by suction power by the pump.

While the ink-jet printer 101 is in a printing operation, the maintenance unit 117 is at a position just below the paper feed unit 111, as shown in FIG. 1. When predetermined conditions are satisfied after completion of the printing operation, for example, when a predetermined time has elapsed with no printing operation or when the printer 101 is powered off, the maintenance unit 117 is horizontally moved to the left in FIG. 1 to a position where each purge cap 116 is opposed to the ink ejection face 2*a* of the corresponding head main body 2. At this position, the maintenance unit 117 can cover each ink ejection face 12*b* with the corresponding purge cap 116. Thus, the maintenance unit 117 can prevent evaporation of ink in the vicinity of each nozzle and can perform the above-described purge operation.

The frame 118 is provided on its lower face with a slide mechanism (not illustrated) for horizontally moving the maintenance unit 117.

While the ink-jet printer 101 is in a printing operation, the belt conveyor mechanism 109 is at a position where the conveyance face of the conveyor belt 108 is opposed to the ink ejection faces 2*a* of the head main bodies 2 in a state wherein the conveyance face of the conveyor belt 108 is parallel to each ejection face 2*a*, as shown in FIG. 1. The position of the belt roller 107 at this time will be referred to as "conveyance position". Before the maintenance unit 117 is moved as described above, the belt roller 107 is swung, as will be described later in detail, to a "withdrawal position" as shown in FIG. 3B, and thereby the belt conveyor mechanism 109 is withdrawn. When the belt roller 107 is at the withdrawal position, the distance between the conveyance face of the conveyor belt 108 and each ink ejection face 2*a* is larger than that when the belt roller 107 is at the conveyance position. A space 9*a* is thus formed between the conveyance face of the conveyor belt 108 and the ink ejection faces 2*a*. The maintenance unit 117 is moved into the space 9*a*.

A swing mechanism for swinging the belt roller 107 will be described with reference to FIGS. 2A and 2B.

The swing mechanism includes a roller supporter 11 rotatably supporting the belt roller 107, and a cam 21 rotatable to change the position of the belt roller 107. Each shaft portion 107*a* of the belt roller 107 on the right in FIG. 1 is supported by the chassis 101*a* through such a swing mechanism, as shown in FIG. 2B. On the other hand, each shaft portion 106*a* of the belt roller 106 on the left in FIG. 1 is rotatably supported by the chassis 110*a* through no such swing mechanism.

Figure 2A:
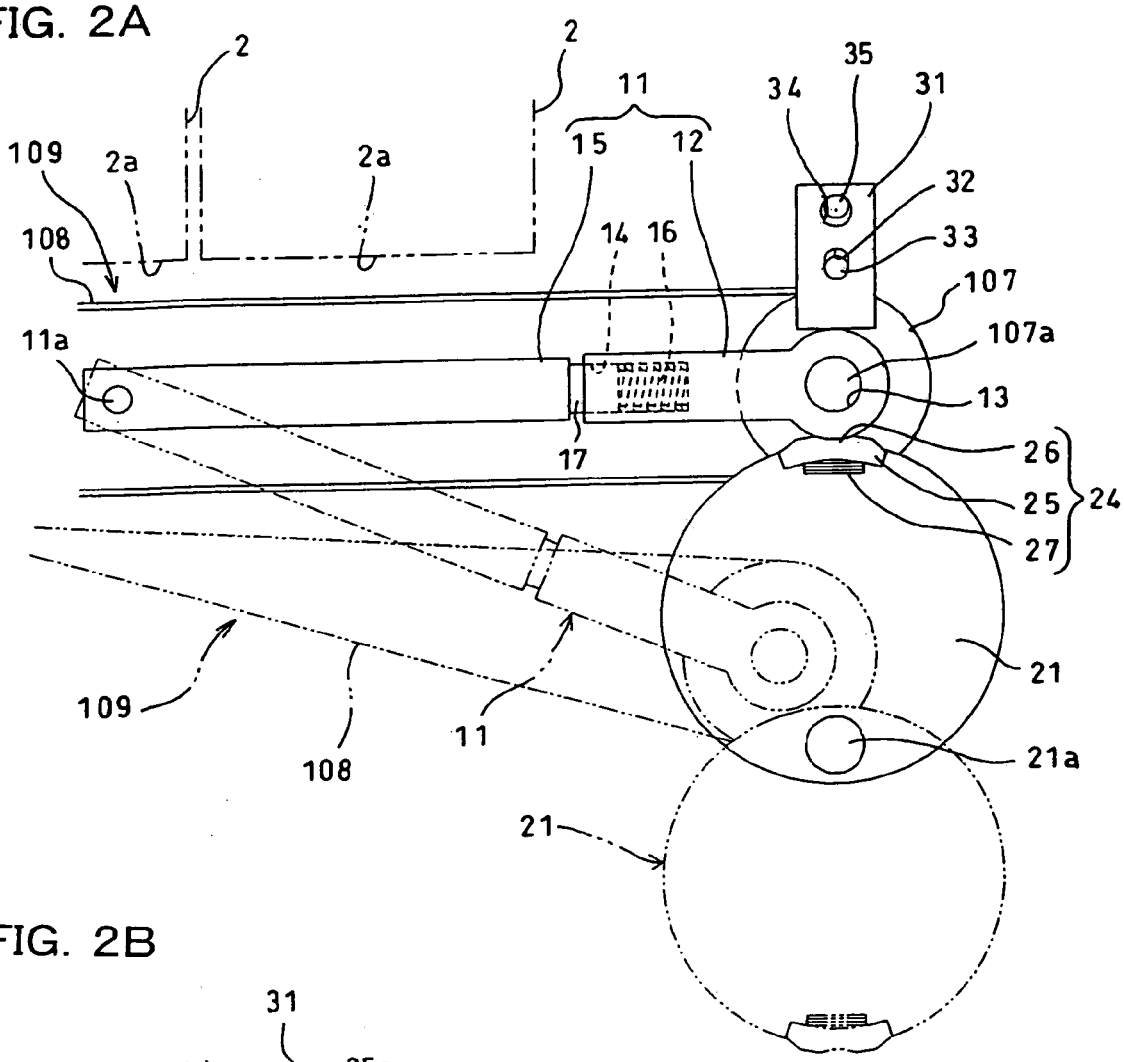
FIG. 2A is an enlarged view of a swing mechanism for swinging one of belt rollers shown in FIG. 1.
Figure 2B:
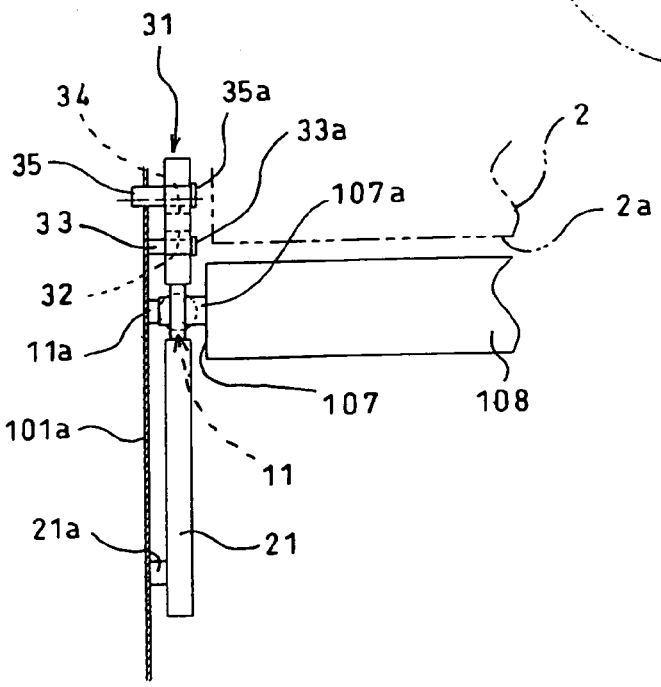
FIG. 2B is an enlarged partial view when the ink-jet printer of FIG. 1 is viewed from the right.

As shown in FIG. 2A, the roller supporter 11 includes a shaft supporter 12 rotatably supporting the shaft portion 107*a* of the belt roller 107, and a supporter 15 slidably inserted in the shaft supporter 12.

Figure 4:
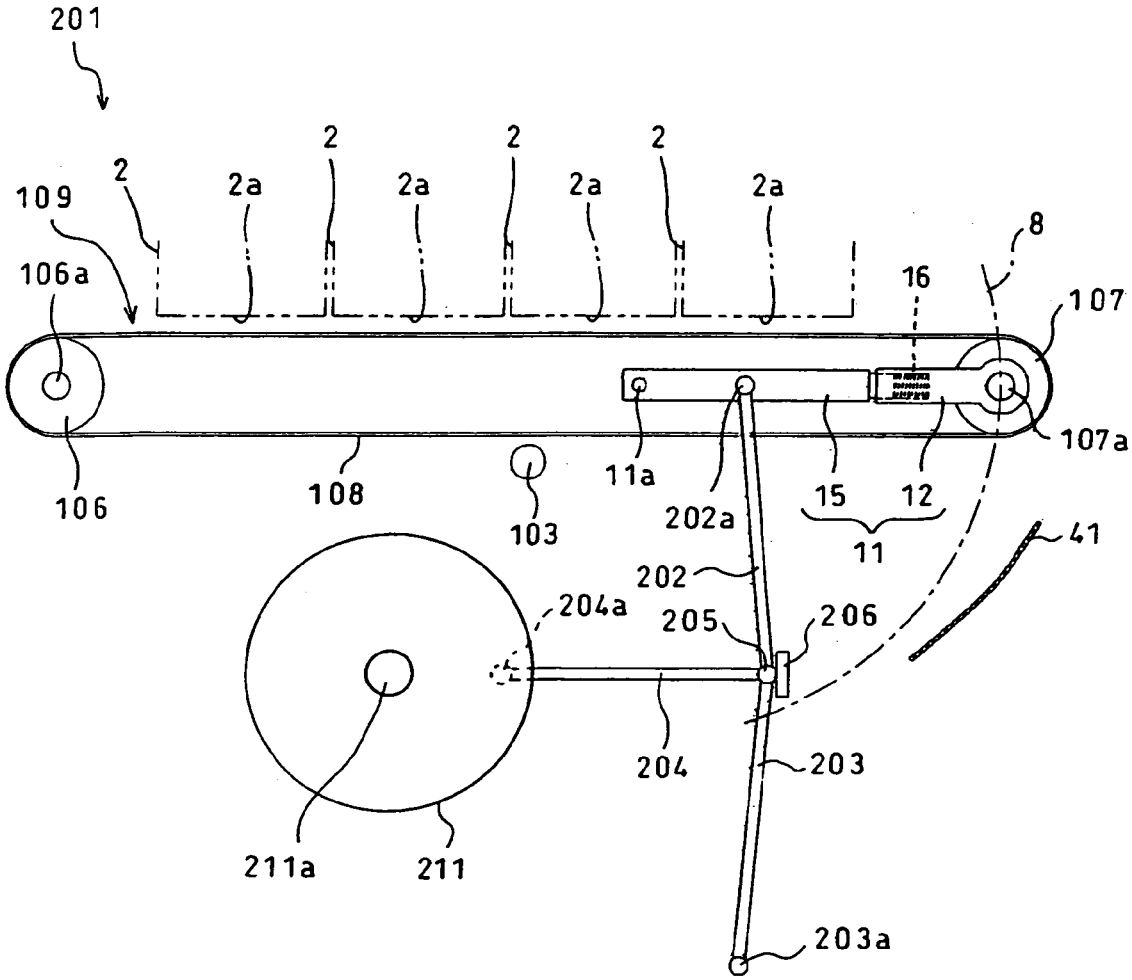
FIG. 4 is a general view of an ink-jet printer according to a second embodiment of the present invention.

The shaft supporter 12 has, at its one end portion, a through-hole 13 along the axis of the shaft portion 107*a* of the belt roller 107. The shaft portion 107*a* is inserted in the through-hole 13. In the other end portion of the shaft supporter 12 facing the supporter 15, a recess 14 is formed so as to have its depth in a direction in which the supporter 15 is inserted. A spring 16 is disposed within the recess 14. The spring 16 biases the shaft supporter 12 and the belt roller 107 to the right in FIG. 2A, that is, in a direction in which the distance between the axes of the belt rollers 106 and 107 increases. A slide portion 17 is formed at one end portion of the supporter 15 facing the shaft supporter 12. The slide portion 17 has its cross section smaller than that of the main part of the supporter 15 so that the slide portion 17 can be inserted in the recess 14. At the other end portion of the supporter 15, a shaft 11*a* is provided that is rotatably supported by the chassis 101*a*, as shown in FIG. 2B. As shown in FIG. 4, the shaft 11*a* is at a position somewhat nearer to the belt roller 107 than the center of a line extending between the shaft portions 106*a* and 107*a* of the belt rollers 106 and 107.

As shown in FIG. 2A, the cam 21 is disk-shaped and a shaft 21*a* is provided in central lower portion of the cam 21. As shown in FIG. 2B, the cam 21 is rotatably supported by the chassis 101*a* through the shaft 21*a*. The cam 21 is rotated when the shaft 21*a* is rotated by a rotation device (not illustrated).

As shown in FIG. 2A, a biasing member 24 is provided on a portion of the outer circumferential surface of the cam 21 being in contact with the side face of the one end portion of the shaft supporter 12. The biasing member 24 includes a receiving portion 25 on which a recess 26 is formed that corresponds to the outline of the side of the one end portion of the shaft supporter 12, and a spring 27 disposed inside the receiving portion 25. The spring 27 biases the receiving portion 25 outward along a radius of the cam 21.

As shown in FIG. 2A, a stopper 31 is disposed so as to be in contact with the uppermost portion of the shaft supporter 12 when the belt roller 107 is at the conveyance position. The stopper 31 is made of a rectangular plate. Oblong holes 32 and 34 are provided at the center and near the upper end of the stopper 31, respectively. Each of the oblong holes 32 and 34 extends vertically, i.e. along the length of the stopper 31. Each of the oblong holes 32 and 34 is formed through the thickness of the stopper 31. Columnar pins 33 and 35 are disposed within the oblong holes 32 and 34, respectively. As shown in FIG. 2B, to prevent the stopper 31 from coming off, stopper portions 33*a* and 35*a* enlarged in diameter are formed at ends of the respective pins 33 and 35 facing a head main body 2. The pin 33 is fixed to the chassis 101*a*. The pin 35 has an axis of rotation deviated from the center of the pin 35 and is rotatably supported by the chassis 101*a*. When the pin 35 is rotated by a rotation device (not illustrated), the position of the pin 35 being in contact with the oblong hole 34 is changed to vertically move the stopper 31. At this time, the stopper 31 vertically slides without being inclined because the lower pin 33 is fixed.

By bringing the stopper 31 thus vertically slidable into contact with the shaft supporter 12, the belt roller 107 can be positioned at the conveyance position so as to be vertically adjustable. Thereby, the degree of parallelism and the distance between the ink ejection faces 2*a* and the conveyance face of the conveyor belt 108 can be adjusted.

Although FIGS. 2A and 2B show the roller supporter 11, the cam 21, the stopper 31, etc. only on one end of the belt roller 107, the same components are provided also on the other end of the belt roller 107.

Next, an operation for withdrawing the belt conveyor mechanism 109 will be described with reference to FIGS. 2A, 3A, and 3B. The belt conveyor mechanism 109 is withdrawn by moving the belt roller 107 from the conveyance position as shown in FIG. 3A to the withdrawal position as shown in FIG. 3B.

As shown in FIG. 2A, the side face of one end portion of the shaft supporter 12 supporting the shaft portion 107*a* of the belt roller 107 is being supported on the outer circumferential surface of the cam 21. Therefore, when the cam 21 is rotated, the roller supporter 11 and the belt roller 107 are swung around the shaft 11*a*. When the cam 21 in a state as shown by a solid line in FIG. 2A has been rotated by 180 degrees, the cam 21 comes in a state as shown by an alternate long and two dashes line in FIG. 2A. The states of the cam 21 shown by the solid line and the alternate long and two dashes line correspond to the conveyance position and the withdrawal position of the belt roller 107, respectively.

Figure 3A:
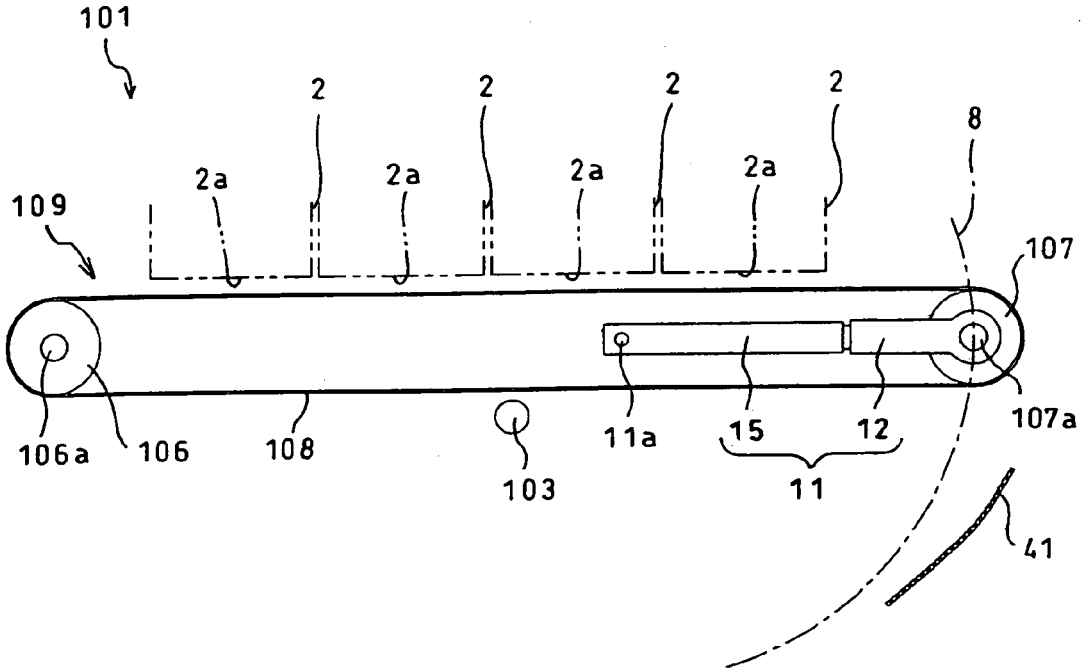
FIG. 3A is a general view of a belt conveyor mechanism when the ink-jet printer of FIG. 1 is in a printing operation.
Figure 3B:
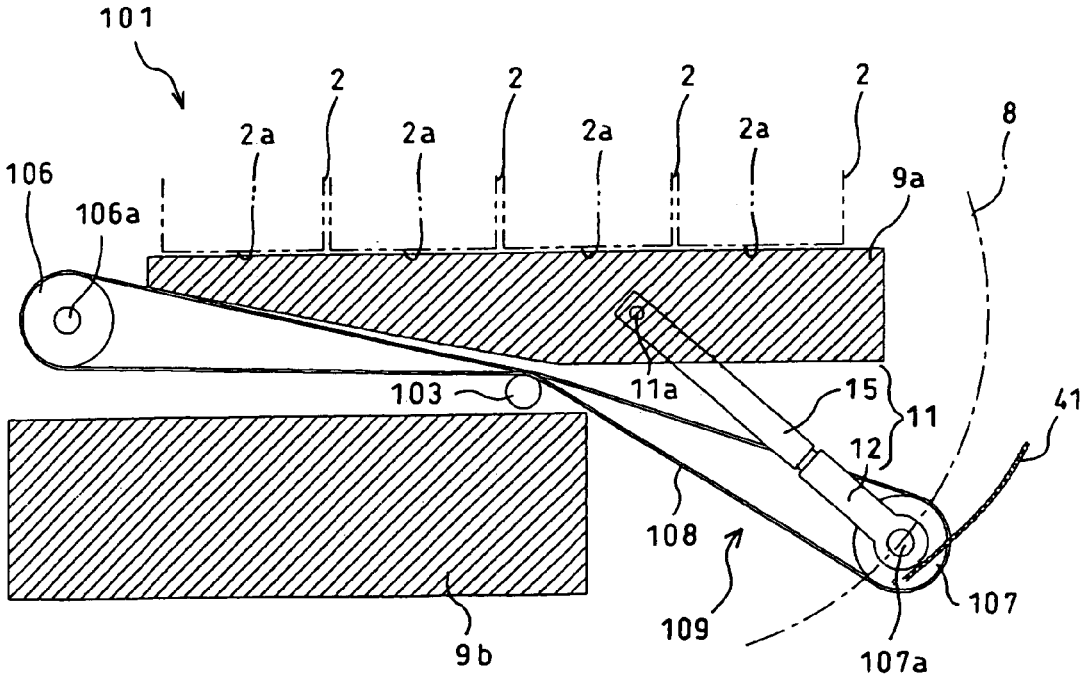
FIG. 3B is a general view showing a state wherein the belt conveyor mechanism of the ink-jet printer of FIG. 1 has been withdrawn.

As the belt roller 107 is swung on an orbit 8 from the conveyance position as shown in FIG. 3A to the withdrawal position as shown in FIG. 3B, the distance between the axes of the belt rollers 106 and 107 decreases accordingly, and the conveyor belt 108 is loosened and stopped by the belt stopper 103. The side face of one end portion of the shaft supporter 12 comes into contact with a guide 41 provided under the belt roller 107. The guide 41 has a shape along the orbit 8 of the belt roller 107. The guide 41 is fixed to the chassis 101*a* as shown in FIG. 2B.

Afterward, when the cam 21 has been further rotated by 180 degrees, the roller supporter 11 and the belt roller 107 return to the state as shown by the solid lines in FIG. 2A. That is, the belt roller 107 returns to the conveyance position as shown in FIG. 3A.

Not only in case of carrying out maintenance with the maintenance unit 117 as shown in FIG. 1, but also in case that a paper is caught between the conveyor belt 108 and an ink ejection face 2*a*, the belt roller 107 may be moved to the withdrawal position. Thereby, the paper being caught can be easily removed out of a space 9*a* as shown in FIG. 3B.

As described above, in the ink-jet printer 101 of this embodiment, the belt roller 107 is swung with a swing radius shorter than the distance between the axes of the belt rollers 106 and 107 at the conveyance position as shown in FIG. 3A. More specifically, the belt roller 107 is swung with a swing radius corresponding to the distance between the center of the shaft 11*a* of the roller supporter 11 and the center of the shaft portions 107*a* of the belt roller 107. Therefore, the space that must be ensured within the printer 101 for withdrawing the belt conveyor mechanism 109 can be designed into a relatively small size, and thus a reduction in size of the printer 101 can be realized.

Further, because the conveyor belt 108 is stopped by the belt stopper 103, as shown in FIG. 3B, a space 9*b* where the conveyor belt 108 does not enter is ensured under the portion of the belt conveyor mechanism 109 between the belt roller 106 and the belt stopper 103. The space 9*b* can receive therein other components of the printer 101, for example, a printed circuit board, ink tanks for supplying ink to the ink-jet heads 2, and so on. Thus, effective use of the space within the printer 101 can be realized.

Because the shaft 11*a* as the center of the swing action of the roller supporter 11 is in between the belt rollers 106 and 107, the space that must be ensured within the printer 101 can surely be reduced in size and in turn the printer 101 can surely be reduced in size.

Because the belt roller 107 can be swung by a simple construction with the cam 21, power saving can be realized.

By sandwiching the shaft supporter 12 by the biasing member 24, provided on the outer circumferential surface of the cam 21, and the stopper 31, the belt roller 107 can surely be positioned at the conveyance position.

Because the recess 26 corresponding to the outline of the side of one end portion of the shaft supporter 12 is formed on the biasing member 24, the side face of the shaft supporter 12 engages with the recess 26 when the belt roller 107 is at the conveyance position. Thereby, the cam 21 can be fixed at a predetermined position.

Because the spring 16 biases the belt roller 107 in a direction in which the distance between the axes of the belt rollers 106 and 107 increases, a proper tension is given to the conveyor belt 108 and thereby the conveyor belt 108 is prevented from being loosened when the conveyor belt 108 conveys a paper.

Because the guide 41 along the orbit of the belt roller 107 is provided, the belt roller 107 can surely be moved on a predetermined orbit and the distance between the axes of the belt rollers 106 and 107 can be decreased more surely. Even in case that the spring 16 is provided that biases the belt roller 107 in a direction in which the distance between the axes of the belt rollers 106 and 107 increases, as in this embodiment, the biasing force of the spring 16 is suppressed by the guide 41, the distance between the axes of the belt rollers 106 and 107 can surely be decreased.

Next, a general construction of an ink-jet printer according to a second embodiment of the present invention will be described with reference to FIG. 4. In the second embodiment, the same components as in the first embodiment are denoted by the same reference numerals as in the first embodiment, respectively, and the description thereof will be-omitted.

The ink-jet printer 201 of this embodiment has generally the same construction as the printer 101 of the first embodiment and differs from the printer 101 of the first embodiment only in part of the swing mechanism. The swing mechanism of this embodiment includes a roller supporter 11, a cam 211, and three links 202, 203, and 204.

The cam 211 has substantially the same disk shape as the cam 21 of the first embodiment. However, the cam 211 has a shaft 211*a* not in a central lower portion as in the first embodiment but at the center of the cam 211. The cam 211 is rotatably supported by a body chassis of the printer 201 through the shaft 211*a*. The cam 211 is rotated when the shaft 211*a* is rotated by a rotation device (not illustrated).

The links 202, 203, and 204 have, at their one ends, connection portions 202*a*, 203*a*, and 204*a*, respectively. The connection portion 202*a* of the link 202 is rotatably connected to substantially the center of the supporter 15. The connection portion 203*a* of the link 203 is rotatably connected to the body chassis of the ink-jet printer 201. The connection portion 204*a* of the link 204 is rotatably connected to the cam 211. The other ends of the links 202 to 204 are connected to each other to form a connection portion 205. The angles between the links 202 to 204 connected at the connection portion 205 can be freely changed. The connection portion 205 can be moved attendant upon a rotation of the cam 211 as will be described later. A stopper 206 is provided so as to be in contact with the connection portion 205 when the belt roller 107 is at the conveyance position as shown in FIG. 4. The stopper 206 is fixed to the chassis.

The cam 211 is connected to the roller supporter 11 through the links 202 and 204 connected in series.

Although FIG. 4 shows the swing mechanism provided only on one end of the belt roller 107, the same swing mechanism is provided also on the other end of the belt roller 107.

Next, an operation for withdrawing the belt conveyor mechanism 109 will be described with reference to FIGS. 4 and 5. The belt conveyor mechanism 109 is withdrawn by moving the belt roller 107 from the conveyance position as shown in FIG. 4 to the withdrawal position as shown in FIG. 5.

Because the link 204 is connected at its connection portion 204*a* to the cam 211, the link 204 moves attendant upon a rotation of the cam 211. Attendant upon movement of the connection portion 205, the other links 202 and 203 rotate. As a result, the roller supporter 11 connected to the link 202 at the connection portion 202*a* is swung around the shaft 11*a*. As shown in FIG. 5, when the cam 211 in the state as shown in FIG. 4 is rotated clockwise by 180 degrees, the link 204 is moved to the left in FIG. 4. The link 203 is rotated counterclockwise in FIG. 4 around its connection portion 203*a*. The link 202 is rotated clockwise in FIG. 4 around its connection portion 202*a*. As a result, the roller supporter 11 is rotated clockwise in FIG. 4 around the shaft 11*a* so that the belt roller 107 is moved to the withdrawal position.

Figure 5:
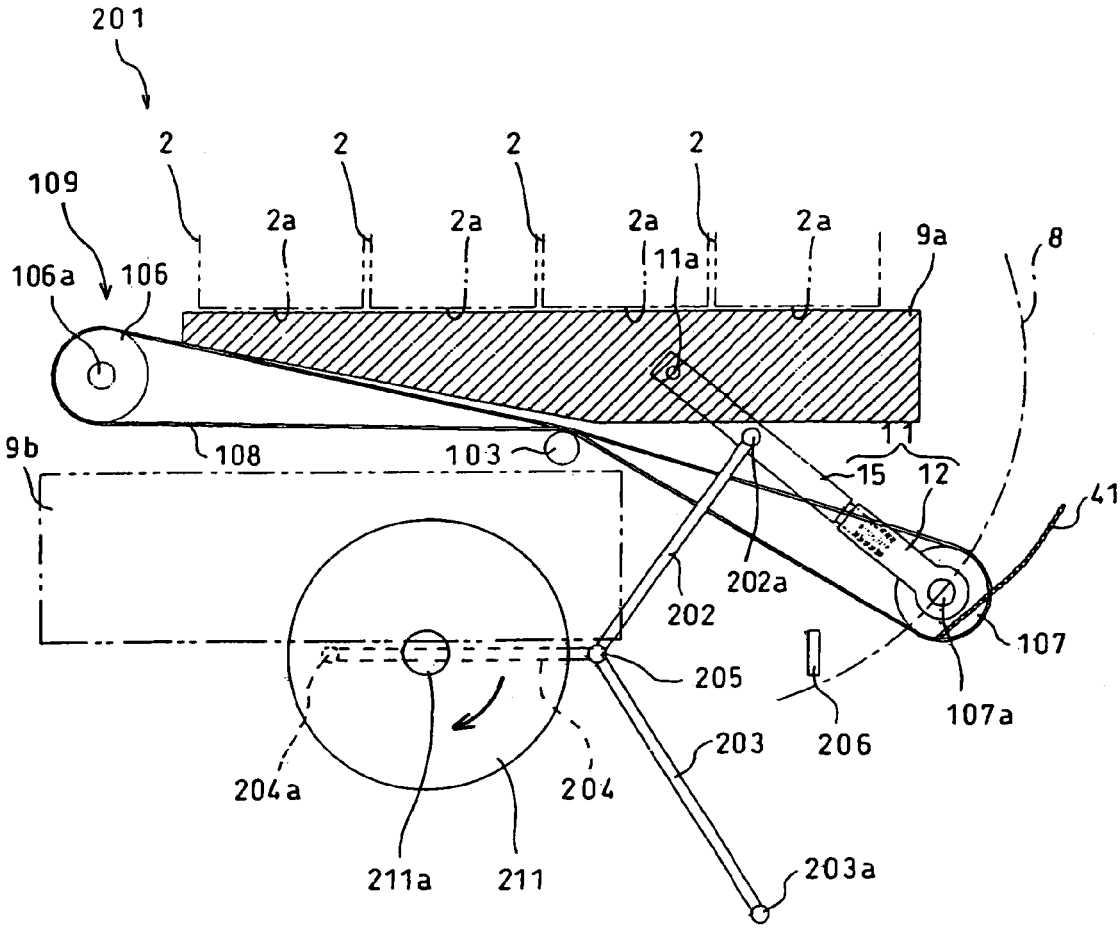
FIG. 5 is a general view showing a state wherein a belt conveyor mechanism of the ink-jet printer of FIG. 4 has been withdrawn.

As the belt roller 107 is swung on the orbit 8 from the conveyance position as shown in FIG. 4 to the withdrawal position as shown in FIG. 5, the distance between the axes of the belt rollers 106 and 107 decreases accordingly, and the conveyor belt 108 is loosened and stopped by the belt stopper 103. The side face of one end portion of the shaft supporter 12 comes into contact with the guide 41.

As described above, also in the ink-jet printer 201 of this embodiment, the belt roller 107 is swung with a swing radius shorter than the distance between the axes of the belt rollers 106 and 107 at the conveyance position as shown in FIG. 4. Therefore, also in this embodiment, an effect that a reduction in size of the printer 201 can be realized can be obtained like the first embodiment.

Further, by disposing the cam 211 and the links 202 to 204 close to the body chassis of the printer 201, as shown in FIG. 5, a space 9*b* similar to that in the first embodiment can be ensured. Therefore, effective use of the space within the printer 201 can be realized like the first embodiment.

Because the belt roller 107 can be swung by a simple construction with the links 202 to 204, power saving can be realized.

Next, a general construction of an ink-jet printer according to a third embodiment of the present invention will be described with reference to FIGS. 6A and 6B. In the third embodiment, the same components as in the first embodiment are denoted by the same reference numerals as in the first embodiment, respectively, and the description thereof will be omitted.

The ink-jet printer 301 of this embodiment has generally the same construction as the printer 101 of the first embodiment and differs from the printer 101 of the first embodiment only in a feature that a movement mechanism is provided in place of the swing mechanism. The movement mechanism includes a roller supporter 311 and a cam 321.

The roller supporter 311 has, at one end portion thereof, a shaft 311*a* rotatably supported by the cam 321. Except this, the roller supporter 311 has the same construction as the roller supporter 11 of the first embodiment as shown in FIG. 2A.

The cam 321 is disk-shaped. A shaft 321*a* is provided at the center of the cam 321. The cam 321 is disposed under the portion of the belt conveyor mechanism 109 between the belt roller 107 and the belt stopper 103. The cam 321 is rotatably supported by a body chassis 301*a* of the printer 301 through the shaft 321*a*. The cam 321 is rotated when the shaft 321*a* is rotated by a rotation device (not illustrated).

The chassis 301*a* has a guide groove 351 for guiding the belt roller 107. The guide groove 351 is formed through the thickness of the chassis 301*a*. One shaft portion 107*a* of the belt roller 107 is inserted in the guide groove 351. The guide groove 351 has a horizontal portion 351*a* and an oblique portion 351*b*. The horizontal portion 351*a* extends horizontally near the shaft portion 107*a* of the belt roller 107 at the conveyance position. The oblique portion 351*b* extends from the horizontal portion 351*a* toward the cam 321. The oblique portion 351*b* is inside a rotational orbit 10 of the belt roller 107 around the center of the corresponding shaft portion 106*a* of the belt roller 106.

Figure 6A:
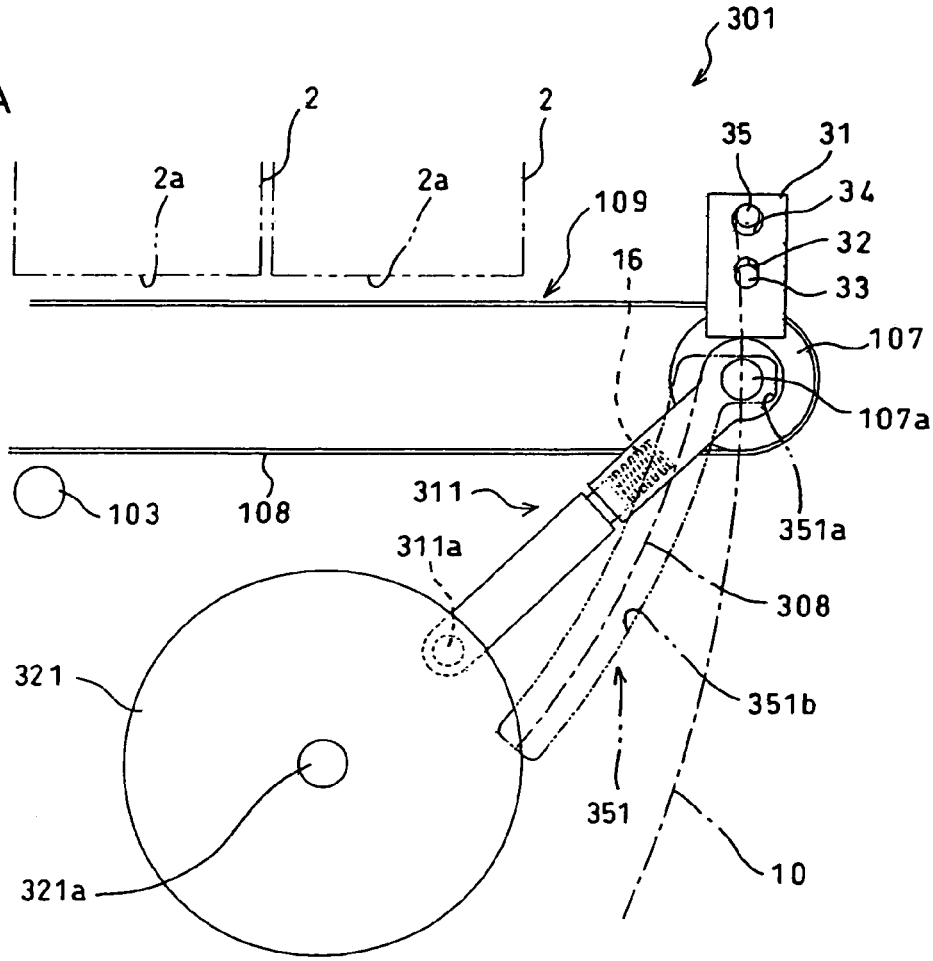
FIG. 6A is a partial view of an ink-jet printer according to a third embodiment of the present invention.
Figure 6B:
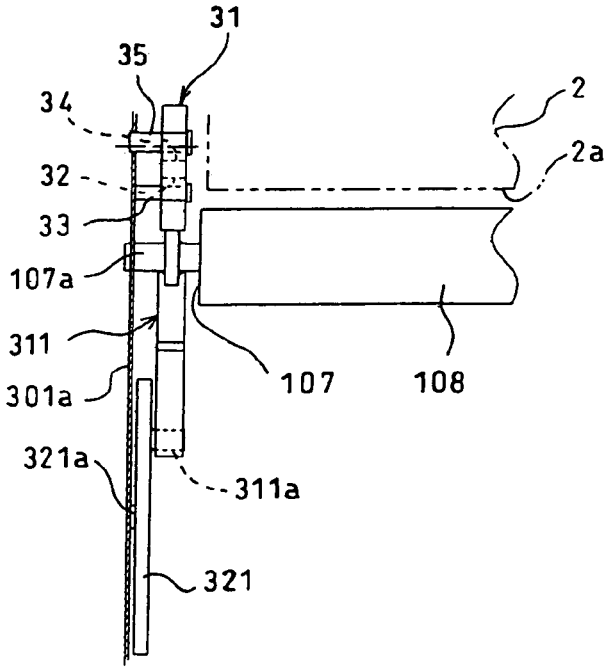
FIG. 6B is an enlarged partial view when the ink-jet printer of FIG. 6A is viewed from the right.

A spring 16 in the roller supporter 311 biases the belt roller 107 to the upper right in FIG. 6A, that is, outward along the length of the roller supporter 311. The shaft portion 107*a* of the belt roller 107 is pressed onto the upper face of the horizontal portion 351*a* of the guide groove 351 by the biasing force of the spring 16. Further, the shaft portion 107*a* of the belt roller 107 is biased by a component of the biasing force along the horizontal portion 351*a* in a direction in which the distance between the belt rollers 106 and 107 increases.

Although FIGS. 6A and 6D show the movement mechanism provided only on one end of the belt roller 107, the same movement mechanism is provided also on the other end of the belt roller 107.

Figure 7A:
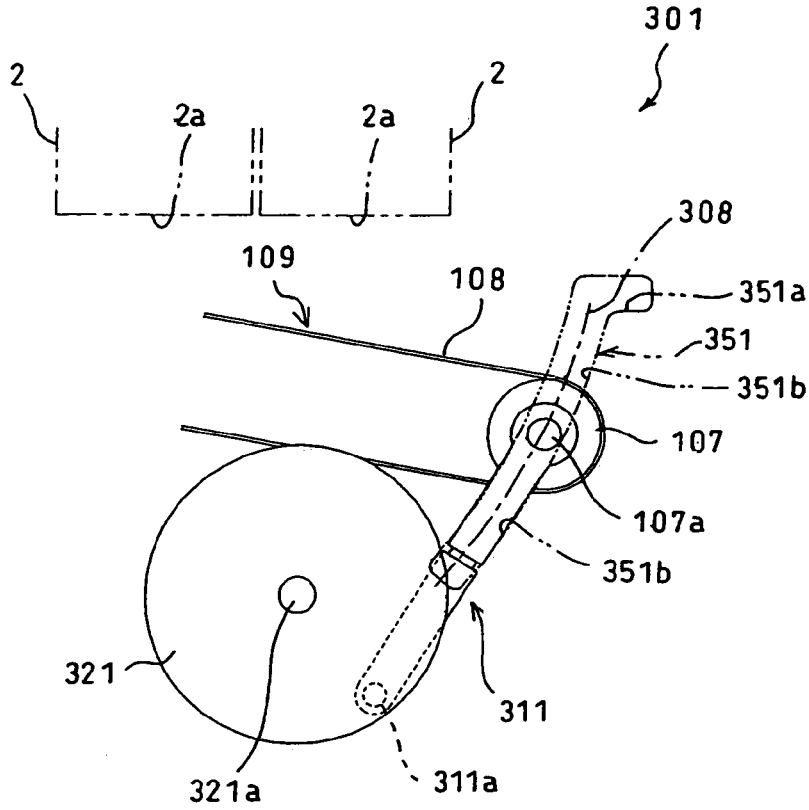
FIG. 7A is a partial view showing a state wherein a belt conveyor mechanism of the ink-jet printer of FIG. 6A is being withdrawn.

Next, an operation for withdrawing the belt conveyor mechanism 109 will be described with reference to FIGS. 7A, 7D, and 8. The belt conveyor mechanism 109 is withdrawn by moving the belt roller 107 from the conveyance position as shown in FIG. 6A to the withdrawal position as shown in FIG. 7B.

Because the shaft portion 107*a* of the belt roller 107 is connected to the cam 321 through the roller supporter 311, the roller supporter 311 and the belt roller 107 move attendant upon a rotation of the cam 321. As shown in FIG. 7A, when the cam 321 in the state as shown in FIG. 6A is rotated clockwise, the shaft 311*a* connected to the cam 321 is moved so as to draw the roller supporter 311 downward. As a result, the shaft portion 107*a* of the belt roller 107 is moved to the lower left along the oblique portion 351*b* of the guide groove 351. That is, the longitudinal center line of the oblique portion 351*b* substantially coincides with an orbit 308 of the belt roller 107. When the cam 321 has been rotated by 180 degrees from the state as shown in FIG. 6A, the belt roller 107 comes to the withdrawal position as shown in FIG. 7B.

Figure 7B:
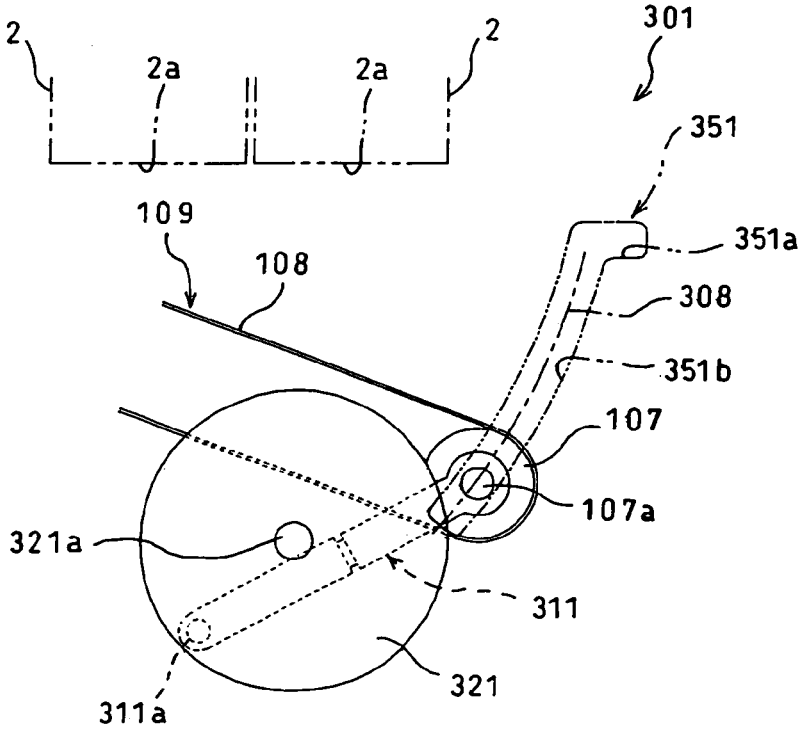
FIG. 7B is a partial view showing a state wherein the belt conveyor mechanism of the ink-jet printer of FIG. 6A has been withdrawn.

Because the longitudinal center line of the oblique portion 351*b* is inside the rotational orbit 10 of the belt roller 107 around the center of the shaft portion 106*a* of the belt roller 106, the distance between the axes of the belt rollers 106 and 107 decreases as the belt roller 107 moves along the oblique portion 351*b* from the conveyance position as shown in FIG. 6A to the withdrawal position as shown in FIG. 7B. In addition, the conveyor belt 108 is loosened and stopped by the belt stopper 103, as shown in FIG. 8.

Afterward, when the cam 321 is further rotated by 180 degrees, the shaft portion 107*a* of the belt roller 107 moves to the upper right along the oblique portion 351*b* of the guide groove 351. Thus, the belt roller 107 returns to the conveyance position as shown in FIG. 6A.

As described above, in the ink-jet printer 301 of this embodiment, when the belt roller 107 is at the withdrawal position, the distance between the axes of the belt rollers 106 and 107 is shorter than that when the belt roller 107 is at the conveyance position. As a result, the space that must be ensured within the printer 301 can be relatively reduced in size. Therefore, also in this embodiment, an effect that a reduction in size of the printer 301 can be realized can be obtained like the first and second embodiments.

Figure 8:
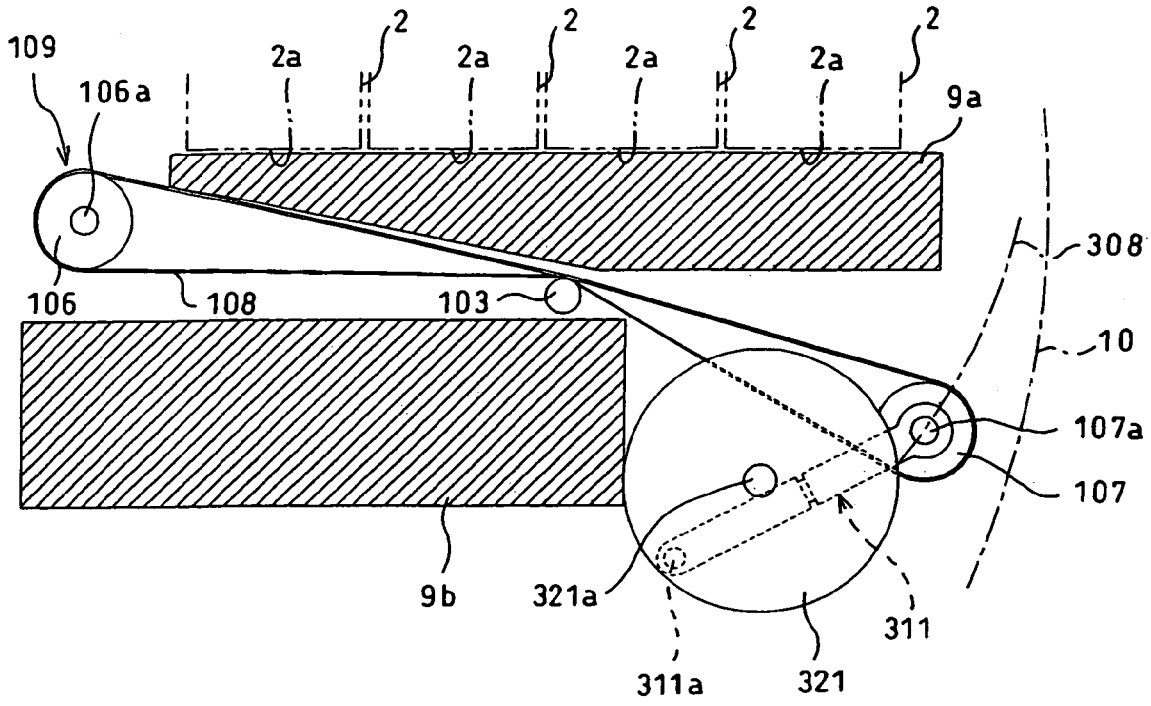
FIG. 8 is a general view showing a state wherein the belt conveyor mechanism of the ink-jet printer of FIG. 6A has been withdrawn.

Further, like the first embodiment, because the conveyor belt 108 is stopped by the belt stopper 103, as shown in FIG. 8, a space 9*b* where the conveyor belt 108 does not enter is ensured under the portion of the belt conveyor mechanism 109 between the belt roller 106 and the belt stopper 103. Therefore, effective use of the space within the printer 301 can be realized, like the first embodiment.

Because the belt roller 107 can be moved by a simple construction with the roller supporter 311 and the cam 321, power saving can be realized.

Because the belt roller 107 is being biased by a component of the biasing force of the spring 16 in the roller supporter 311, in a direction in which the distance between the axes of the belt rollers 106 and 107 increases, a proper tension is given to the conveyor belt 108 and thereby the conveyor belt 108 is prevented from being loosened when the conveyor belt 108 conveys a paper.

Next, a general construction of an ink-jet printer according to a fourth embodiment of the present invention will be described with reference to FIGS. 9A, 9B, and 9C. In the fourth embodiment, the same components as in the first and third embodiments are denoted by the same reference numerals as in the first and third embodiments, respectively, and the description thereof will be omitted.

The ink-jet printer 401 of this embodiment has generally the same construction of the printer 301 of the third embodiment and differs from the printer 301 of the third embodiment only in the construction of the movement mechanism. The movement mechanism of this embodiment includes a slider 411 supporting one shaft portion 107*a* of the belt roller 107, and a pinion gear 421 for sliding the slider 411 attendant upon a rotation of the pinion gear 421.

The slider 411 has, at its one end, an enlarged portion 412 enlarged in comparison with the other end of the slider 411. The enlarged portion 412 has a shaft receiving portion 413 as a recess for receiving the shaft portion 107*a* of the belt roller 107. A receiving member 414 as a plate is disposed within the shaft receiving portion 413 so as to be in contact with the shaft portion 107*a* of the belt roller 107. A pit 415 is formed on a side wall of the shaft receiving portion 413 such that the pit 415 has its depth perpendicular to the face of the receiving member 414 to be in contact with the shaft portion 107*a* of the belt roller 107. A spring 416 is provided within the pit 415 so as to bias the receiving member 414 toward the shaft portion 107*a* of the belt roller 107. A rack 417 is formed on the side face of the slider 411 facing the pinion gear 421, so as to extend along the length of the slider 411. The pinion gear 421 engages with the rack 417.

Figure 9A:
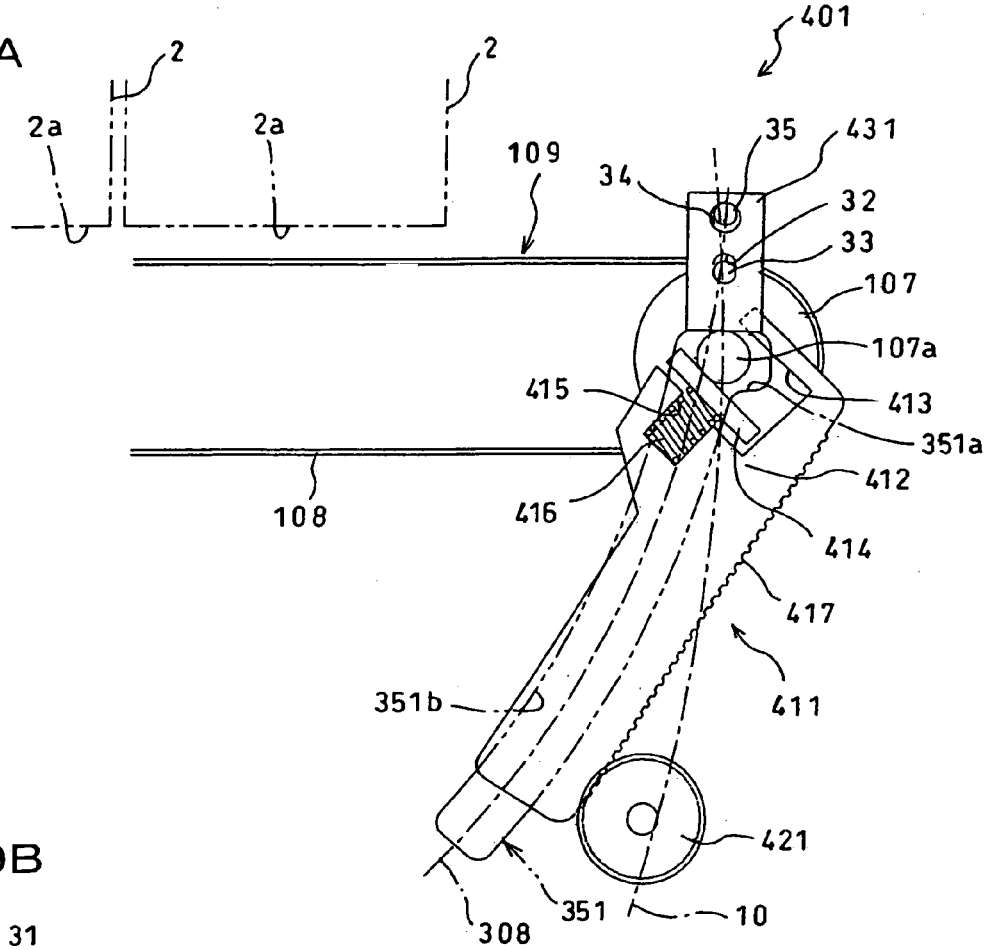
FIG. 9A is a partial view of an ink-jet printer according to a fourth embodiment of the present invention.

The pinion gear 421 engages with a portion of the rack 417 near the other end of the slider 411 when the belt roller 107 is at the conveyance position as shown in FIG. 9A. As shown in FIG. 9B, the pinion gear 421 is rotatably supported by a body chassis 401 of the printer 401. The slider 417 slides when the pinion gear 421 is rotated by a rotation device (not illustrated).

A stopper 431 is provided so as to be in contact with the uppermost portion of the belt roller 107 at the conveyance position. While the stopper 31 of the first embodiment is to be in contact with the uppermost portion of the shaft supporter 12, the stopper 431 of this embodiment is to be in contact with the uppermost portion of the belt roller 107, Except this, the stopper 431 of this embodiment has substantially the same construction as the stopper 31 of the first embodiment.

The chassis 401*a* has the same guide groove 351 as in the third embodiment. The shaft portion 107*a* of the belt roller 107 is inserted in the guide groove 351.

Figure 9B:
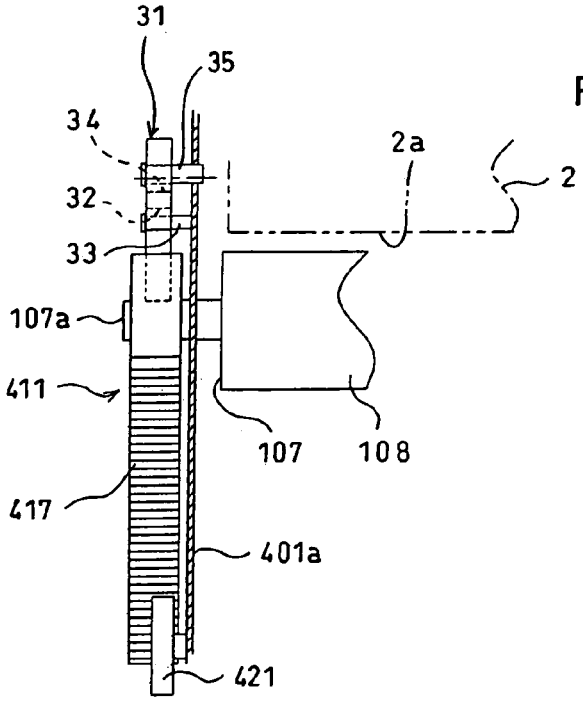
FIG. 9B is an enlarged partial view when the ink-jet printer of FIG. 9A is viewed from the right.
Figure 9C:
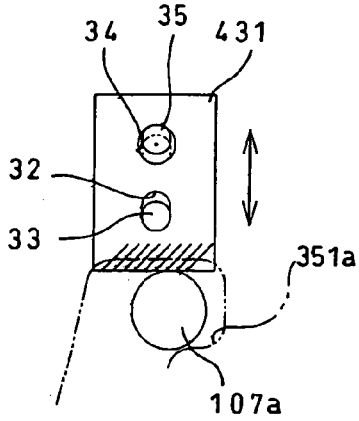
FIG. 9C is an enlarged view of a stopper disposed above a belt roller shown in FIG. 9A.

Although FIGS. 9A to 9C show the movement mechanism provided only on one end of the belt roller 107, the same movement mechanism is provided also on the other end of the belt roller 107.

Next, an operation for withdrawing the belt conveyor mechanism 109 will be described with reference to FIGS. 9A and 10. The belt conveyor mechanism 109 is withdrawn by moving the belt roller 107 from the conveyance position as shown in FIG. 9A to the withdrawal position as shown in FIG. 10.

Because the shaft portion 107*a* of the belt roller 107 is supported by the slider 411, the belt roller 107 is displaced as the slider 411 is slid by the pinion gear 421. When the pinion gear 421 as shown in FIG. 9A is rotated counterclockwise, the slider 411 is slid to the lower left. Attendant upon this, the shaft portion 107*a* of the belt roller 107 moves to the lower left along the oblique portion 351*b* of the guide groove 351. Thus, the belt roller 107 comes to the withdrawal position as shown in FIG. 10.

Figure 10:
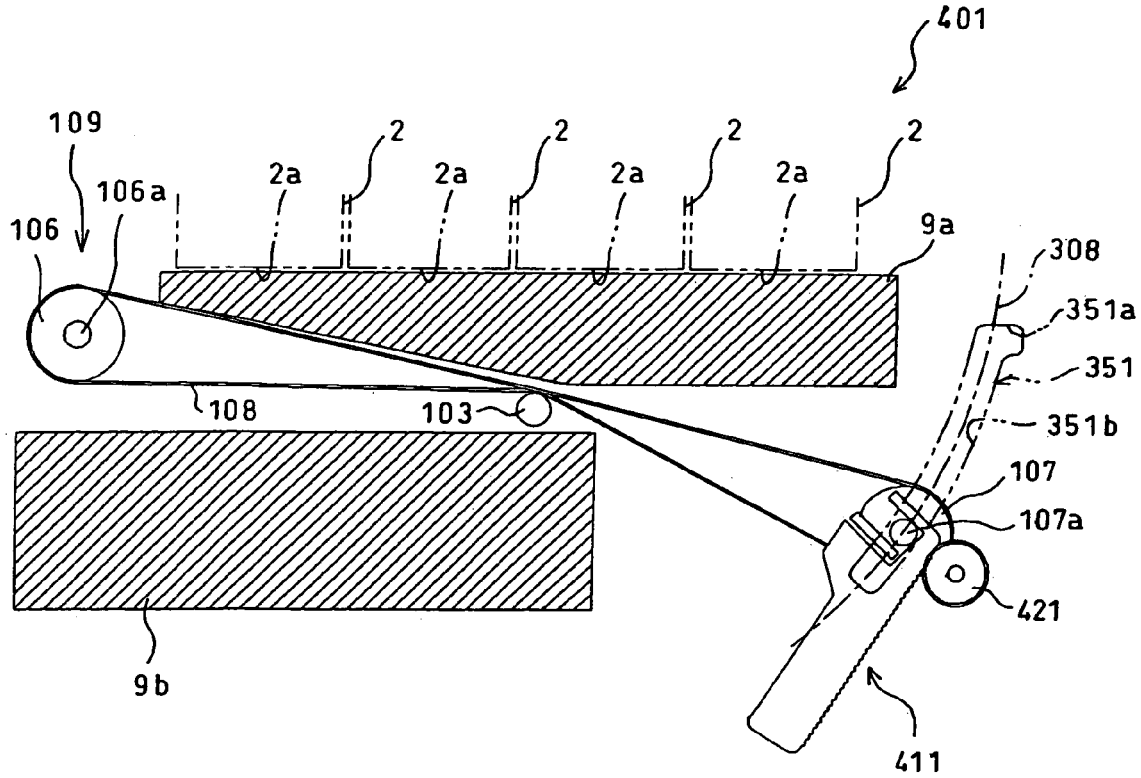
FIG. 10 is a general view showing a state wherein a belt conveyor mechanism of the ink-jet printer of FIG. 9A has been withdrawn.

For the same reason as in the third embodiment, the distance between the axes of the belt rollers 106 and 107 decreases as the belt roller 107 moves along the oblique portion 351*b* from the conveyance position as shown in FIG. 9A to the withdrawal position as shown in FIG. 10. In addition, the conveyor belt 108 is loosened and stopped by the belt stopper 103.

Afterward, when the pinion gear 421 is rotated clockwise, the shaft portion 107*a* of the belt roller 107 moves together with the slider 411 to the upper right along the oblique portion 351*b* of the guide groove 351. Thus, the belt roller 107 returns to the conveyance position as shown in FIG. 9A.

As described above, also in the ink-jet printer 401 of this embodiment, like the third embodiment, when the belt roller 107 is at the withdrawal position, the distance between the axes of the belt rollers 106 and 107 is shorter than that when the belt roller 107 is at the conveyance position. As a result, the space that must be ensured within the printer 401 can be relatively reduced in size. Therefore, also in this embodiment, an effect that a reduction in size of the printer 401 can be realized can be obtained like the first to third embodiments.

Further, like the first embodiment, because the conveyor belt 108 is stopped by the belt stopper 103, as shown in FIG. 10, a space 9*b* where the conveyor belt 108 does not enter is ensured under the portion of the belt conveyor mechanism 109 between the belt roller 106 and the belt stopper 103. Therefore, effective use of the space within the printer 401 can be realized, like the first embodiment.

Because the belt roller 107 can be moved by a simple construction with the slider 411 and the pinion gear 421, power saving can be realized.

The shaft portion 107*a* of the belt roller 107 is pressed onto the upper face of the horizontal portion 351*a* of the guide groove 351 by the biasing force of the spring 416 in the slider 411. Further, the shaft portion 107*a* of the belt roller 107 is biased by a component of the biasing force along the % horizontal portion 351*a* in a direction in which the distance between the belt rollers 106 and 107 increases. Thus, because the belt roller 107 is being biased in a direction in which the distance between the axes of the belt rollers 106 and 107 increases, a proper tension is given to the conveyor belt 108 and thereby the conveyor belt 108 is prevented from being loosened when the conveyor belt 10B conveys a paper.

Next, a general construction of an ink-jet printer according to a fifth embodiment of the present invention will be described with reference to FIGS. 11A and 11B. In the fifth embodiment, the same components as in the first, third, and fourth embodiments are denoted by the same reference numerals as in the first, third, and fourth embodiments, respectively, and the description thereof will be omitted.

The ink-jet printer 501 of this embodiment has generally the same construction of the printer 401 of the fourth embodiment and differs from the printer 401 of the fourth embodiment only in the construction of the movement mechanism. The movement mechanism of this embodiment includes an arm 511 supporting, at its one end, one shaft portion 107*a* of the belt roller 107; and a gear 521 connected to the other end of the arm 511. The gear 521 is rotatably supported by a body chassis of the printer 501.

The arm 511 has, at its one end, an enlarged portion 512 enlarged in comparison with the other end of the arm 511. The enlarged portion 512 has a shaft receiving portion 513 as a recess for receiving the shaft portion 107*a* of the belt roller 107. A receiving member 514 as a plate is disposed within the shaft receiving portion 513 so as to be in contact with the shaft portion 107*a* of the belt roller 107. A spring 516 is provided between a side wall of the shaft receiving portion 513 and the receiving member 514 so as to bias the receiving member 514 toward the shaft portion 107*a* of the belt roller 107.

The body chassis of the printer 501 has the same guide groove 351 as in the third embodiment. The shaft portion 107*a* of the belt roller 107 is inserted in the guide groove 351. When the belt roller 107 is at the conveyance position, the arm 511 and the guide groove 351 are substantially symmetrical with respect to a vertical line extending through the center of the shaft portion 107*a* of the belt roller 107.

Figure 11A:
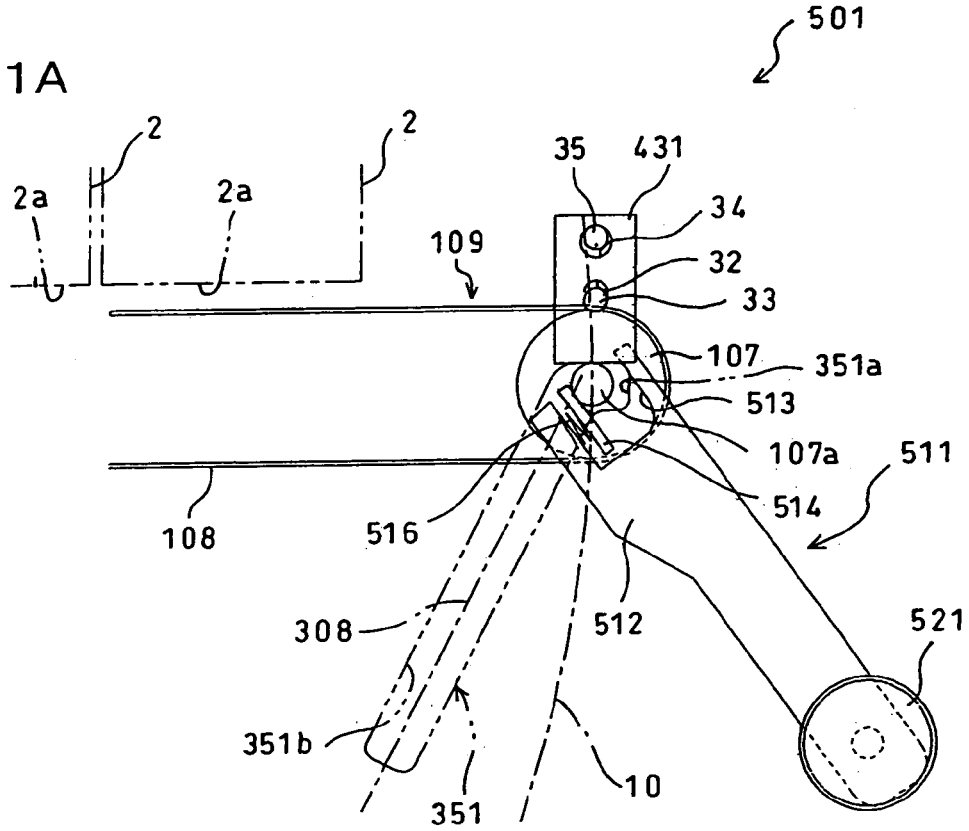
FIG. 11A is a partial view of an ink-jet printer according to a fifth embodiment of the present invention.
Figure 11B:
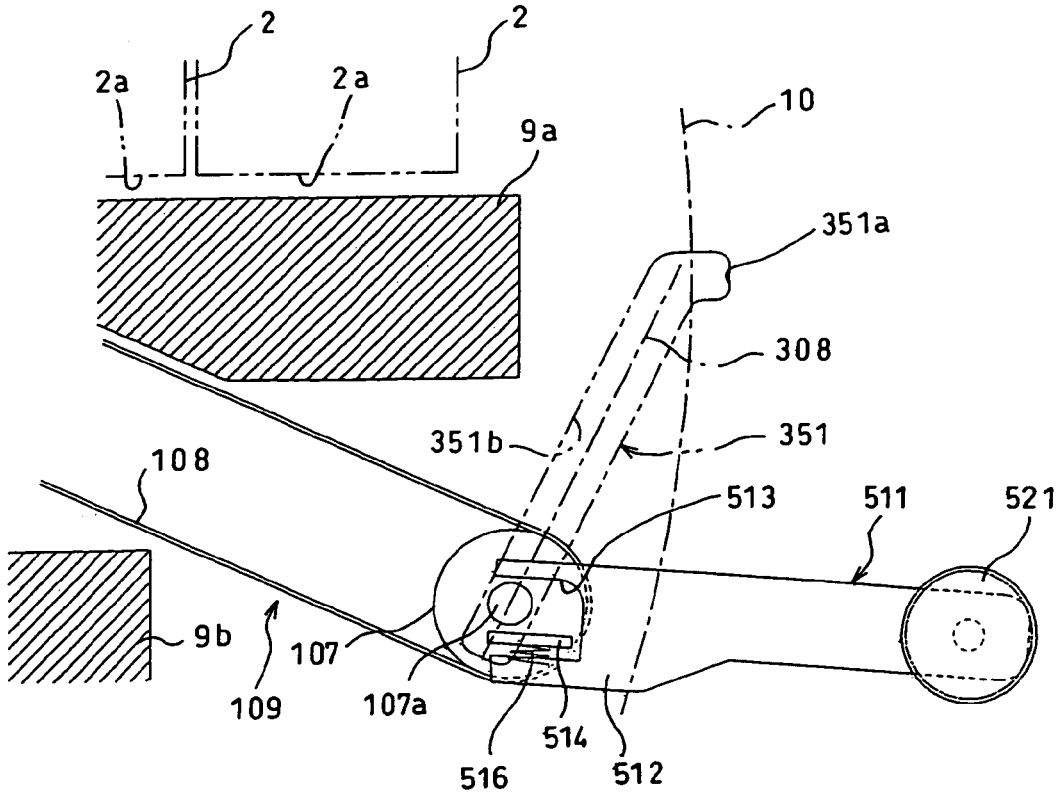
FIG. 11B is a general view showing a state wherein a belt conveyor mechanism of the ink-jet printer of FIG. 11A has been withdrawn.

Although FIGS. 11A and 11B show the movement mechanism provided only on one end of the belt roller 107, the same movement mechanism is provided also on the other end of the belt roller 107.

Next, an operation for withdrawing the belt conveyor mechanism 109 will be described. The belt conveyor mechanism 109 is withdrawn by moving the belt roller 107 from the conveyance position as shown in FIG. 11A to the withdrawal position as shown in FIG. 11B.

Because the shaft portion 107*a* of the belt roller 107 is supported by the arm 511, the belt roller 107 is displaced as the arm 511 is swung through the gear 521. When the gear 521 as shown in FIG. 11A is rotated counterclockwise by a rotation device (not illustrated), the arm 511 is swung to the lower left. Attendant upon this, the shaft portion 107*a* of the belt roller 107 moves to the lower left along the oblique portion 351*b* of the guide groove 351. Thus, the belt roller 107 comes to the withdrawal position as shown in FIG. 11B.

For the same reason as in the third embodiment, the distance between the axes of the belt rollers 106 and 107 decreases as the belt roller 107 moves along the oblique portion 351*b* from the conveyance position as shown in FIG. 11A to the withdrawal position as shown in FIG. 11B. In addition, the conveyor belt 108 is loosened and stopped by the belt stopper 103, like in FIG. 10.

Afterward, when the gear 521 is rotated clockwise, the shaft portion 107*a* of the belt roller 107 moves together with the arm 511 to the upper right along the oblique portion 351*b* of the guide groove 351. Thus, the belt roller 107 returns to the conveyance position as shown in FIG. 11A.

As described above, also in the ink-jet printer 501 of this embodiment, like the third and fourth embodiments, when the belt roller 107 is at the withdrawal position, the distance between the axes of the belt rollers 106 and 107 is shorter than that when the belt roller 107 is at the conveyance position. As a result, the space that must be ensured within the printer 501 can be relatively reduced in size. Therefore, also in this embodiment, an effect that a reduction in size of the printer 501 can be realized can be obtained like the first to fourth embodiments.

Further, like the first embodiment, because the conveyor belt 108 is stopped by the belt stopper 103, as shown in FIG. 11B, a space 9*b* where the conveyor belt 108 does not enter is ensured under the portion of the belt conveyor mechanism 109 between the belt roller 106 and the belt stopper 103. Therefore, effective use of the space within the printer 501 can be realized, like the first embodiment.

Because the belt roller 107 can be moved by a simple construction with the arm 511 and the gear 521, power saving can be realized.

The shaft portion 107*a* of the belt roller 107 is pressed onto the upper face of the horizontal portion 351*a* of the guide groove 351 by the biasing force of the spring 516 in the arm 511. Further, the shaft portion 107*a* of the belt roller 107 is biased by a component of the biasing force along the horizontal portion 351*a* in a direction in which the distance between the belt rollers 106 and 107 increases. Thus, because the belt roller 107 is being biased in a direction in which the distance between the axes of the belt rollers 106 and 107 increases, a proper tension is given to the conveyor belt 108 and thereby the conveyor belt 108 is prevented from being loosened when the conveyor belt 108 conveys a paper.

The spring 16, 416, or 516 for biasing the belt roller 107 in a direction in which the distance between the axes of the belt rollers 106 and 107 at the conveyance position increases, the stopper 31 or 431, or the guide 41 may be omitted.

A bearing may be attached on each shaft portion 107*a* of the belt roller 107 so that the roller supporter 11, the slider 411, or the arm 511 may support the shaft portion 107*a* through the bearing.

The present invention is not limited to such a line-type ink-jet printer as described in the embodiments. The present invention is applicable likewise to a serial-type ink-jet printer, an ink-jet type facsimile machine or copying machine.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An ink-jet recording apparatus comprising:

a first roller;

a second roller;

a looped conveyor belt wrapped around the first and second rollers to be stretched between the first and second rollers;

a conveyance face formed on the conveyor belt to convey a record medium;

an ink-jet head having an ink ejection face on which a plurality of nozzles each of which ejects ink are formed; and a roller supporter that supports the first roller so that the first roller can be swung between a conveyance position where the conveyance face is opposed to the ink ejection face in a state wherein the conveyance face is parallel to the ink ejection face, and a withdrawal position where the conveyance face is distant from the ink ejection face by a distance larger than a distance between the conveyance face and the ink ejection face when the first roller is at the conveyance position, with a swing radius shorter than a distance between axes of the first and second rollers when the first roller is at the conveyance position, wherein a distance between axes of the first and second rollers is changed with respect to each other when the first roller is swung between the conveyance position and the withdrawal position.

2. The ink-jet recording apparatus according to claim 1, further comprising a biasing member that biases the first roller in a direction in which the distance between the axes of the first and second rollers when the first roller is at the conveyance position increases.

3. The ink-jet recording apparatus according to claim 1, further comprising a rotator that can rotate to change a position of the first roller.

4. The ink-jet recording apparatus according to claim 3, wherein the rotator is a cam and an outer circumferential surface of the cam is in contact with one of the first roller and the roller supporter.

5. The ink-jet recording apparatus according to claim 3, further comprising one of a link that connects one of the first roller and the roller supporter to the rotator, and a plurality of links that connect one of the first roller and the roller supporter to the rotator, the plurality of links being connected to each other in series so that angles between the plurality of links can be changed.

6. The ink-jet recording apparatus according to claim 1, wherein a center of a swing action of the roller supporter is in between the first roller at the conveyance position and the second roller.

7. The ink-jet recording apparatus according to claim 1, further comprising a positioner that positions the first roller at the conveyance position so that a distance between the ink ejection face and the conveyance face can be adjusted.

8. The ink-jet recording apparatus according to claim 7, further comprising:

a cam that can rotate to change a position of the first roller and has an outer circumferential surface being in contact with one of the first roller and the roller supporter; and a biasing member provided on the outer circumferential surface of the cam.

9. The ink-jet recording apparatus according to claim 8, wherein the biasing member has a recess corresponding to an outline of one of the first roller and the roller supporter.

10. The ink-jet recording apparatus according to claim 1, further comprising a guide provided along an orbit of the first roller.

* * * * *